US006763183B1

(12) United States Patent
Huang

(10) Patent No.: US 6,763,183 B1
(45) Date of Patent: Jul. 13, 2004

(54) COOLING AND ISOLATING STRUCTURE FOR EXTERNAL CASING OF HOT AIR BLOWING GUN

(75) Inventor: Yung-Kuan Huang, Chia Yi Hsien (TW)

(73) Assignee: Yeu Chyuan Industrial Co., Ltd., Chia Yi Hsien (TW)

( * ) Notice: Subject to any disclaimer, the term of this patent is extended or adjusted under 35 U.S.C. 154(b) by 0 days.

(21) Appl. No.: 10/457,312

(22) Filed: Jun. 9, 2003

(51) Int. Cl.[7] ..... F24H 3/00
(52) U.S. Cl. ..... 392/384
(58) Field of Search ..... 392/384, 385, 392/379, 380, 383, 485, 488, 489, 473, 476; 34/96, 97

(56) References Cited

U.S. PATENT DOCUMENTS 6,370,326 B2 * 4/2002 Cheng ..... 392/379

FOREIGN PATENT DOCUMENTS

WO 83/02753 * 8/1983

* cited by examiner

*Primary Examiner*—John A. Jeffery
(74) *Attorney, Agent, or Firm*—Alan D. Kamrath; Nikolai & Mersereau, P.A.

(57) ABSTRACT

A cooling and isolating structure for an external casing of a hot air blowing gun and particularly the structure of the hot air blowing gun at the front end of its interior has a nozzle coupled to the inner barrel, with heating wires disposed inside the inner barrel. An embedded ring is disposed at one end of the nozzle, and a groove is disposed at a position corresponding to the inner side of the external casing of the hot air blowing gun. The insulating embedded plate can be disposed between the nozzle and the external casing of the hot air blowing gun to define an insulated and cooling isolating space to effectively isolate the heat conduction from the nozzle and to prevent the external casing of the hot air blowing gun from being overheated or partially deformed.

6 Claims, 3 Drawing Sheets

COOLING AND ISOLATING STRUCTURE FOR EXTERNAL CASING OF HOT AIR BLOWING GUN

BACKGROUND OF THE INVENTION

Field of the Invention

The present invention relates to a cooling and isolating structure for the external casing of a hot air blowing gun, comprising an insulating embedded plate with excellent insulating effect to isolate the interior of the hot air blowing gun and the nozzle, to define an insulated and cooling isolated space to effectively isolate the heat conducted from the casing pipe to the hot air blowing gun, and to prevent the external casing of the hot air blowing gun from being deformed by overheating.

The U.S. Pat. No. 6,370,326 discloses a hot air blowing gun comprising an inner barrel with high-impedance heating wire inside and a fan motor assembly at its rear end for blowing the heat outward. A tapered nozzle is installed to the front end of the inner barrel. An outward positioning flange with a plurality of through holes on its surface is disposed on the bottom side of the nozzle such that the outward positioning flange can be fixed onto the inner edge of the front end of the hot air blowing gun, while keeping a predetermined distance between the nozzle and its surfaced. A protective cap with appropriate convergence is disposed correspondingly to the front end of the hot air blowing gun and keeps a gap between the periphery of the nozzle. During the assembly of aforementioned components, the nozzle and inner barrel can be installed and fixed onto the inner edge of the front end of the hot air blowing gun, and the protective cap can be installed on the periphery at the front end of the hot air blowing gun. Thus, when the user turns on the hot air blowing gun, the fan motor assembly blows away the high-temperature heat produced by the heating wire in the inner barrel in a direction, and on the other hand, it will produce wind to pass through the through holes on the flange around the inner barrel, and blow out from the gap between the protective cap and the nozzle. Since the heating wire is disposed inside the inner barrel, and the heat is insulated properly by the wall of the inner barrel so that the temperature on the outside of the inner barrel is relatively low. The cooler airflow blown out from the flange of the nozzle and the through holes can effectively lower the contact temperature of the flange and the inner periphery of the hot air blowing gun. Therefore, such an arrangement can prevent the hot air blowing gun from accumulating heat or being deformed, and thus it accomplishes a safer effect for high temperature control.

However, even though an appropriate gap for isolation is kept between the inner barrel and the external casing of the hot air blowing gun, the cold airflow can pass through and attain the effect of insulating the heat and cooling the external casing of the hot air blowing gun. Due to the flange having a plurality of through holes disposed on the nozzle, which is in contact at an angle of 360 degrees with the external casing of the hot air blowing gun, there is solid substance between the through holes of the flange and the through holes, which blocks the cold airflow and enhances the effect of conducting heat so that the high temperature heat inside the nozzle can be conducted to the surrounding of the flange through the physical section of the flange. Therefore, the heat produced will focus easily on the flange, and further cause an extremely high temperature in the flange, so that the position, where the external casing of the hot air blowing gun and the flange are in contact, has larger impact of high temperature on a larger contact area, which may easily cause partial deformation to the external casing. Particularly, if the hot air blowing gun has been used continuously for a long time, the situation of the deformation will be very serious. Therefore, the prior-art hot air blowing gun is not suitable for being used continuously for a long time.

Further, the hot air blowing gun uses a fan motor assembly to draw in the air from outside of the gun and to blow the hot air produced by the thermal resistor in the inner barrel to supply hot air to users. Therefore, the dust and cotton fiber in the air will flow into the gun together with the airflow. After the hot air blowing gun has been used for a long period of time, the dust and cotton fiber will accumulate in the gun. Similarly, dust and cotton fiber will also accumulate on the circular wall of the nozzle reducing the diameter of the through hole and decreasing the airflow, and thus greatly reducing the cooling effect of the nozzle, which can easily cause partial deformation to the hot air blowing gun, and shortening the life of the hot air blowing gun.

SUMMARY OF THE INVENTION

Therefore, in order to improve the insulating effect between the hot air blowing gun and the nozzle according to the prior art, an embedding ring is disposed at the rear end of the nozzle so that the embedding ring can be embedded and secured onto the insulating embedded plate. The insulating embedded plate can be secured on the inner side of the external casing in order to maintain an appropriate distance between the nozzle and the external casing of the hot air blowing gun. Since the insulating embedded plate is made of excellent insulating and heat-resistant materials and has a plurality of ventilation holes, it isolates the heat of the nozzle, and the high heat produced by the nozzle will be carried away by the cold air between the nozzle and the sleeve. Therefore, it will not have any effect of conducting high heat to the external casing, and assures that the external casing will not be deformed or produce heat. Such arrangement makes the application of the hot air blowing gun safer and more reliable.

DETAILED DESCRIPTION OF THE PREFERRED EMBODIMENTS

Figure 1:
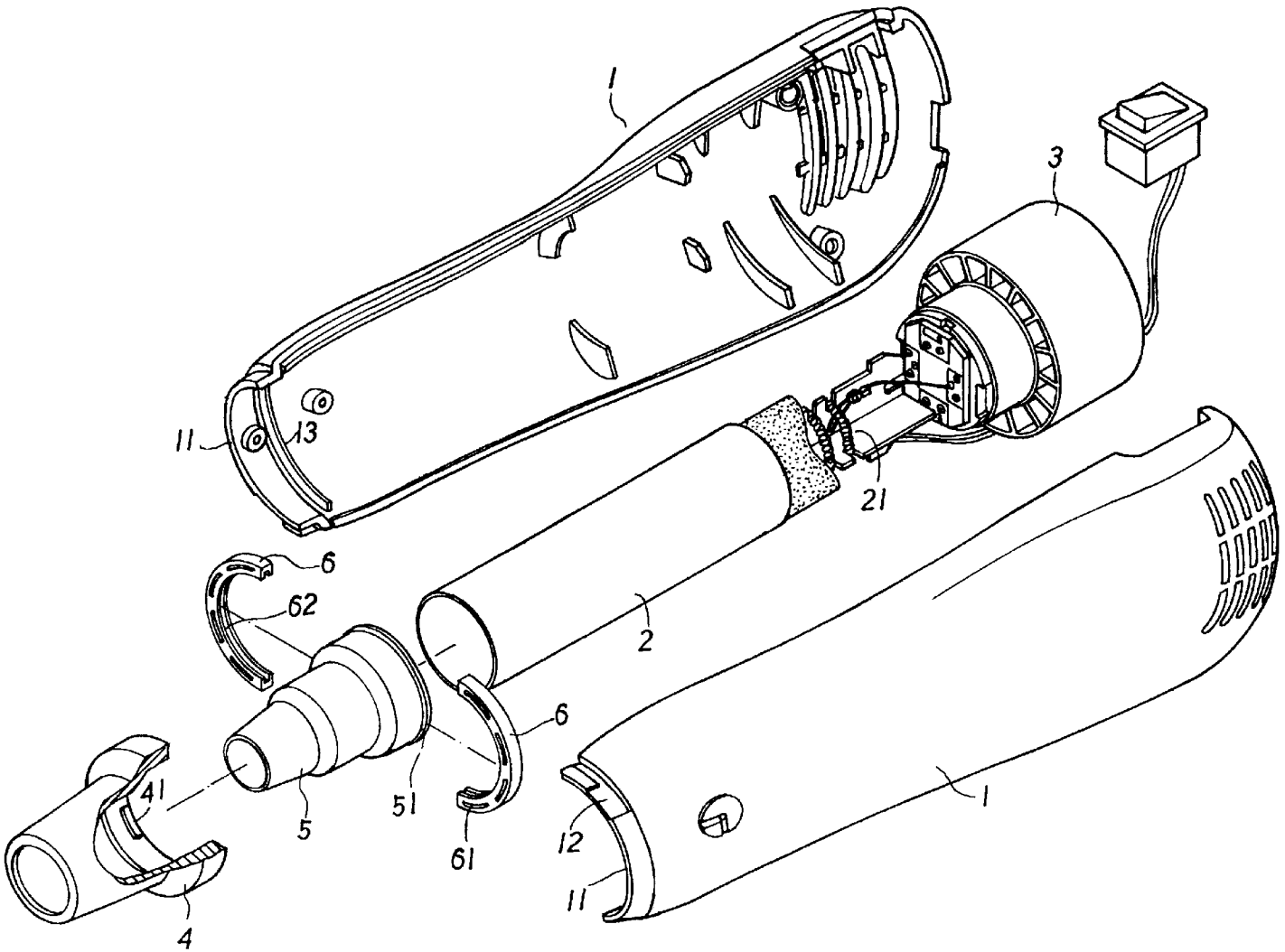
FIG. 1 is a perspective diagram of the disassembled parts of the present invention.
Figure 2:
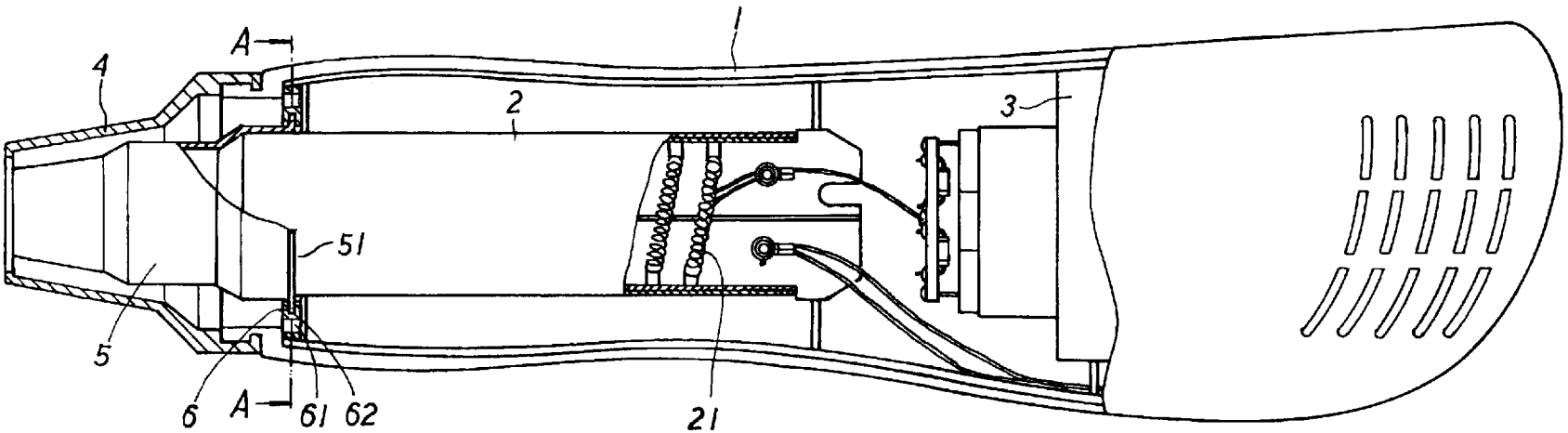
FIG. 2 is the cross-sectional diagram of the side view of the present invention.
Figure 3:
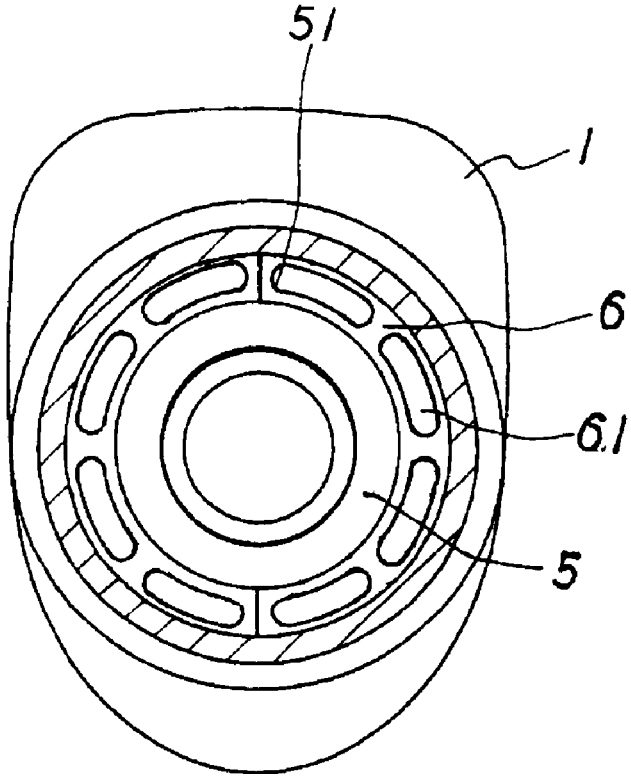
FIG. 3 is the cross-sectional diagram of the section A—A shown in FIG. 2.

Please refer to FIGS. 1 and 2 for the structure of the hot air blowing gun, which comprises an external casing 1 and an inner barrel 2 inside the external casing 1. A heating wire 21 is disposed inside the inner barrel 2, and a fan motor assembly 3 is disposed inside the external casing 1 at the end of the inner barrel 2. A tapered protective cap 4 is coupled to the front end of the external casing 1. A corresponding embedded groove 12 is disposed on the surface of the stairway-like edge 11 at the front end of the external casing 1. A protruded embedded section 41 protrudes correspondingly from the surface of the inner wall of the protective cap 4 and is inserted inside the protective cap 4 by the stairway-like edge 11 at the front end of the external casing 1. The protruded embedded section 41 slides into the embedded groove 12, and the protective cap 4 is fixed to the front end of the external casing 1 by rotating the protective cap 4. Further, a semi-circular inwardly concave groove 13 is disposed at a position corresponding to the inner wall at the front end of the external casing 1. A nozzle 5 is set at the front end of the inner barrel 2 such that the end of the nozzle 5 can be bent outward from the edge of the nozzle 5 to form a semicircular embedded ring 51. Further, a reciprocal semi-circular insulating embedded plate 6 is made of excellent heat-resisting plastic material. A plurality of ventilation holes 61 are disposed on the sides of two insulating embedded plates 6, and a concave embedded groove 62 is disposed on the inner side of the insulating embedded plate 6.

Therefore, the embedded ring 51 of the nozzle 5 can be embedded into the embedding groove 62 on the inner side of the insulating embedded plate 6. The insulating embedded plate 6 can be placed into the groove 13, disposed on the inner wall at the front end of the external casing 1, such that an isolated distance is defined between the nozzle and the external casing. The nozzle has a tapered design such that the nozzle 5 can be accommodated into the protective cap 4, defining an isolating space between the nozzle 5 and the inner wall of the protective cap 4.

Since the contact between the nozzle 5 and the external casing 1 is by indirect contact of the insulating embedded plate 6 with the external casing 1, even if the hot air flows in the nozzle 5 and produces high heat to the nozzle 5, the plurality of ventilation holes 61 on the insulating embedded plate 6 allows cold air to flow through and isolate the space between the nozzle 5 and the protective cap 4. In addition to the effect of carrying away the heat, the heat produced by the nozzle 5 cannot be conducted to the external casing 1 through the insulating embedded plate 6. Since the insulating embedded plate 6 has excellent heat insulating effect that can fully isolate the heat conducted from the nozzle 5, and the heat produced by the nozzle can be carried away by the cold air flowing between the nozzle 5 and the protective cap 4, it will not have an effect of producing high heat to the external casing 1 and can prevent the external casing 1 from being deformed or heated. It also allows for continuous use of the hot air blowing gun over a long time, and makes the application of the hot air blowing gun safer and more reliable.

Additionally, after the gun has been used continuously for a long time and although the dust and cotton fiber will reduce the diameter of the through hole 61 on the insulating plate 6 and decrease the cold airflow between the nozzle 5 and the protective cap 4, it will not produce any high heat effect to the external casing 1 since the air between the nozzle 5 and the protective cap 4 and the insulating embedded plate 6 are excellent insulating elements. It prevents the external casing 1 from being deformed or heated, and the insulating embedded plate 6 also has good heat-resisting effect and thus can extend its life of use.

While the invention has been described by way of examples and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

Brief Description of the Numbered Item in the FIGURE

| | |
|---|---|
| 1 External Casing | 11 Stairway-like Edge |
| 12 Embedded Groove | 13 Inward Concave Groove |
| 2 Inner Barrel | 21 Heating Wire |
| 3 Fan Motor Assembly | 41 Protruded Embedded Section |
| 4 Protective Cap | 51 Semicircular Embedded Ring |
| 5 Nozzle | 61 Ventilation Hole |
| 6 Insulating Embedded plate | |
| 62 Concave Embedded Groove | |

What is claimed is:

1. A cooling and isolated structure for a hot air blowing gun, comprising an inner barrel disposed in an external casing and having a heating wire therein; a fan motor assembly disposed in said external casing at one end of said inner barrel; a tapered nozzle disposed at a front end of said inner barrel, with said nozzle being accommodated in a tapered protective cap at a front end of said external casing and having an embedded ring bent outward from an edge of said nozzle; and an insulating embedded plate separately formed from the nozzle and the tapered protective cap, with the insulating embedded plate having a plurality of ventilation holes, with the insulating embedded plate engaging the tapered protective cap and the embedded ring of the tapered nozzle to form an insulated and cooling isolated space between the tapered nozzle and the tapered protective cap at the front end of said external casing.

2. The cooling and isolated structure for a hot air blowing gun of claim 1, wherein said insulating embedded plate is a pair of reciprocal semi-circular plates.

3. A cooling and isolated structure for a hot air blowing gun, comprising an inner barrel disposed in an external casing and having a heating wire therein; a fan motor assembly disposed in said external casing at one end of said inner barrel;

a tapered nozzle disposed at a frost end of said inner barrel, with said nozzle being accommodated in a tapered protective cap at a front end of said external casing and having an embedded ring bent outward from the edge of said nozzle, and an insulating embedded plate having a plurality of ventilation holes, with the insulating embedded plate being between the external casing and the embedded ring of the tapered nozzle to form an insulated and cooling isolated space between the tapered nozzle and the tapered protective cap at the front end of said external casing, and wherein said insulating embedded plate at its inner surface comprises a concave embedding groove for mutually engaging with the embedded ring at one end of said nozzle.

4. The cooling and isolated structure for a hot air blowing gun of claim 3, with a groove being disposed at the front end of the external casing to accommodate the insulating embedded plate.

5. The cooling and isolated structure for a hot air blowing gun of claim 4, wherein said insulating embedded plate is a pair of reciprocal semi-circular plates.

6. The cooling and isolated structure for a hot air blowing gun of claim 3, wherein said insulating embedded plate is a pair of reciprocal semi-circular plates.

* * * * *